US006113666A

United States Patent [19]

Kompan et al.

[11] Patent Number: 6,113,666

[45] **Date of Patent: *Sep. 5, 2000**

[54] METHOD OF MAGNETICALLY-CONTROLLABLE, ELECTROSLAG MELTING OF TITANIUM AND TITANIUM-BASED ALLOYS, AND APPARATUS FOR CARRYING OUT SAME

[75] Inventors: Jaroslav Yurievich Kompan; Danylo Andreevich Dudko; Victor Ivanovich Trefilov; Ivan Jaroslavovich Kompan, all of Kyiv, Ukraine

[73] Assignee: Jaroslav Yurievich Kompan, Kyiv, Ukraine

[ * ] Notice: This patent is subject to a terminal disclaimer.

[21] Appl. No.: 09/132,035

[22] Filed: Aug. 11, 1998

[51] Int. Cl.[7] ..... C22B 9/18

[52] U.S. Cl. ..... 75/10.26; 75/10.46; 75/10.67; 75/612; 373/42; 373/67; 373/88

[58] Field of Search ..... 75/10.14, 10.23, 75/10.45, 10.46, 375, 10.16, 10.17, 10.26, 10.67, 612; 266/211, 90; 373/42, 67, 88; 164/498, 492

[56] References Cited

U.S. PATENT DOCUMENTS

| | | | |
|---|---|---|---|
| 2,640,860 | 6/1953 | Herres . | |
| 2,686,822 | 8/1954 | Evans et al. . | |
| 2,880,483 | 4/1959 | Hanks et al. . | |
| 3,067,473 | 12/1962 | Hopkins . | |
| 3,516,476 | 6/1970 | Scriver . | |
| 3,619,464 | 11/1971 | Kapfenberg et al. . | |
| 3,713,808 | 1/1973 | Wallbaum et al. . | |
| 3,867,976 | 2/1975 | Suarez et al. | 164/52 |
| 3,989,091 | 11/1976 | Medovar et al. . | |
| 4,185,682 | 1/1980 | Ksendzyk et al. | 164/252 |
| 4,303,797 | 12/1981 | Roberts | 373/94 |
| 4,610,296 | 9/1986 | Hiratake et al. . | |
| 4,726,840 | 2/1988 | Choudhury et al. . | |
| 4,779,802 | 10/1988 | Coombs . | |
| 4,902,341 | 2/1990 | Okudaira et al. . | |
| 5,127,468 | 7/1992 | Poulsen . | |
| 5,160,532 | 11/1992 | Benz et al. . | |
| 5,174,811 | 12/1992 | Schmidt et al. | 75/581 |
| 5,649,992 | 7/1997 | Carter, Jr. et al. . | |
| 5,737,355 | 4/1998 | Damkroger | 373/50 |
| 5,974,075 | 10/1999 | Kompan | 373/42 H |

OTHER PUBLICATIONS

Morozov et al.; Investigation of Various Methods of Melting and Casting of Titanium Alloys; *Titanium '80, Science and Technology*; May 1980, pp. 2157–2167.

Kurevich, et al.; The Electroslag Melting of Titanium Alloy Ingots;E.O. Paton Welding Institute, Ukr. SSR Academyof Sciences; pp. 33–38, 1963 no month.

Chronister et al.; Induction Skull Melting of Titanium and Other Reactive Alloys; *Journal of Metals*, Sep. 1986; pp. 51–54.

*Primary Examiner*—Jeffrey Snay
*Assistant Examiner*—Tima McGuthry-Banks
*Attorney, Agent, or Firm*—Hovey, Williams, Timmons & Collins

[57] ABSTRACT

A method of magnetically-controllable, electroslag melting of titanium and titanium-based alloys is provided that includes the effect of an external radial magnetic field on the metallurgical melt. The field forms at least two adjoining melting layers which are rotated horizontally in opposite directions, and causes intralayer and meridional toroidal rotation of the melt. The uniform hydrodynamic structure of the melt over the total length of the ingot is stabilized by changing the melting voltage. The external radial magnetic field and the use of a fluoride-chloride flux improves the refinement of metal (by reducing harmful inclusions), condenses the metal structure, and provides high chemical and physical homogeneity of the metal ingot.

17 Claims, 5 Drawing Sheets

METHOD OF MAGNETICALLY-CONTROLLABLE, ELECTROSLAG MELTING OF TITANIUM AND TITANIUM-BASED ALLOYS, AND APPARATUS FOR CARRYING OUT SAME

BACKGROUND OF THE INVENTION

1. Field of the Invention

This invention relates generally to the electrometallurgical melting of titanium and titanium-based alloys. In particular, the invention relates to a method of magnetically-controllable, electroslag melting of titanium and multicomponent high-strength titanium-based alloys, and to an apparatus for carrying out the same.

This invention is useful in the production of titanium and high-alloy titanium alloys characterized by a high density of cast metal, an absence of gas pores and nonmetallic inclusions, and low contents of admixtures. The apparatuses and methods of the invention are particularly useful in the production of special-purpose alloys used for products that operate under conditions of long-term alternating loads, chemically aggressive media, and cryogenic temperatures, e.g., in aviation and shipbuilding industries, power generation and chemistry, nuclear power sector, etc.

2. Description of the Prior Art

Methods for the electroslag melting of metals discussed in Trochun I. et al., Magnetic Control of Crystallization in the Electroslag Process, *Svarochnoe Proiz-vodstvo*, 11:3–5 (1965).

The above study contains an analysis of the interaction between longitudinally-radial field and electric current, proceeding in a metallurgical pool. It has been demonstrated that such interactions result in bulk electromagnetic forces that affect the melt hydrodynamics and ingot crystallization. However, due to the unidirectional nature of vectors of melting current and the induction of external magnetic field in the course of titanium electrode melting, these forces may cause only an insignificant effect on the hydrodynamics of the melt, and thus exert little influence upon metal purification from admixtures and inclusions, leading to improvement of its macrostructures, microstructures, and quality.

The effect on electric current flowing in slag and metal pools, caused by the radial constituent of external magnetic fields, and resulting in more intense hydrody-namic motion of the melt is discussed in Paton B.E. et al., Development and Studies of Methods of Controlling the Structure of a Crystallizing Electroslag-Produced Ingot by Superposing a Magnetic Field, *Problem Spetsialnoi Elektrometallurgii*, 4:3–7 (1989). However, the melt rotation in the horizontal plane generated by electromagnetic forces, results in the formation of a crater in the central area of a metal pool, leading to the occurrence of a recess in this area, and therefore a negatively affected quality of ingot being melted.

Existing ESR methods are lacking in that they cannot provide metal homogeneity over the total length of the ingot. This is generally caused by the absence of mechanisms aimed at the stabilization of the ingot crystalline structure over the total length thereof by way of stabilizing the hydrodynamic situation in slag and metal melts.

This problem is most critical in the production of ingots made of high-strength, special-purpose alloys used for products that operate under conditions of complicated alternating loads and corrosion. When melting such alloys, it's highly desirable to differentiate the motion of melt in various areas thereof in terms of direction and intensity. Alloy elements used in these melts comprise heavy metals such as W, Mo, Fe, and Cr which must be uniformly distributed throughout the metal in the course of melting along with light alloy elements such as Al. Therefore, the more intense the melt motion, the more uniform the composition and the more uniform the composition of the crystallized ingot. Here, it is preferable to intensify such stream flows as well as to make the directions of their motion as complicated as possible. This will permit a more complete metallurgical process of dissolution of inclusions in the slag, thereby providing thermodynamic purification of the metal from gaseous admixtures and gas pores carried out by this slag.

SUMMARY OF THE INVENTION

The invention provides methods and apparatuses for magnetically-controllable, electroslag melting of titanium and titanium-based alloys wherein, due to the effect on the melting current of at least two opposite radial constituents of the external magnetic field, it would be possible to provide an intense hydrodynamic motion of melt, accompanied by formation of at least two adjoining melt layers rotating in opposite directions. The methods and apparatuses of the invention further provide intralayer and substantially meridional toroidal rotations of the melt, which permit the creation of favorable conditions for improving the homogeneity of the melt's dynamic composition as well as the metallurgical composition of an ingot.

The methods and apparatuses of the invention also provide the passage of electric current through at least three ring-shaped members in such a way that the current in adjoining ring members would flow in opposite directions. At least 3 ring-shaped members are necessary to provide at least two layers rotating in opposite directions.

The methods and apparatuses of the invention provide one radial constituent which affects the melting current inside the slag pool, and another radial constituent which affects the melting current inside the metal pool, thereby providing rotation of the melts in said pools in opposite directions. The invention also provides a means for affecting the melting current with an external magnetic field. In one embodiment, the melting of an ingot in a fixed crystallizer is provided, while another embodiment provides for the melting of an ingot in the course of lifting a crystallizer.

The invention utilizes spongy titanium, spongy titanium with alloy additives, metallic titanium, or titanium-based alloys as a consumable electrode. The pressure within the melting area is from about $0.9\times10^5$ to about $3.6\times10^5$ Pa, and preferably from about $1.4\times10^5$ to $2.0\times10^5$ Pa.

The methods and apparatuses of the invention provide for the stabilization conditions necessary for the uniform distribution of the flow of a current-carrying fluid, thereby causing a uniform hydrodynamic structure of the melt over the total length of the ingot, preferably while maintaining constant the melting current, the feed rate of consumable electrode, and the electrode gap. The methods and apparatuses of the invention provide optimum conditions for running the processes, in which the melting current and feed rate of the consumable electrode results in the consumable electrode melting in the upper portion of the slag pool with a maximum permissible value of the electrode gap. Furthermore, conditions for the invention provide optimum processes by smoothly decreasing the melting voltage, and by providing apparatuses for carrying out such a mode.

The methods of magnetically-controllable, electroslag melting of titanium and titanium-based alloys comprise the steps of:

- providing a consumable electrode in electrical contact with a crystallizer filled with a metered amount of flux;
- evacuating a crystallizer melting area and supplying an inert gas thereto;
- passing an electric current through said electrode, causing the melting of flux and the consumable electrode and resulting in the production of a melt of slag and metal pools;
- affecting said melting current with an external magnetic field having at least two opposite radial constituents disposed in parallel planes, thereby resulting in the formation, within the melt bulk, of at least two adjoining melt layers rotating in opposite directions, as well as intralayer and substantially meridional toroidal rotations of the melt;
- crystallizing a metal ingot at the interface with said metal pool as said metal pool is replenished through the melting of the consumable electrode;
- withdrawing said ingot from said crystallizer.

Here, it is preferable to generate the radial constituents by passing an electric current through at least three ring-shaped conductor members surrounding the crystallizer. The ring-shaped conductor members are spaced at equal distances not exceeding half total depth of the slag and metal pools. The electric current in adjacent ring members is passed in mutually opposite directions.

In one embodiment of the invention, the melting current is affected by an external magnetic field. More specifically, one of the radial constituents affects the slag pool current, while another opposite radial constituent affects the metal pool current, thereby causing the rotation of the melts in mutually opposite directions.

Preferably, the consumable electrode comprises a material selected from the group consisting of spongy titanium, spongy titanium with alloying additives, titanium, and titanium-based alloys. The inert gas pressure is preferably from about $0.9\times10^5$ to about $3.6\times10^5$ Pa, and preferably from about $1.4\times10^5$ to about $2.0\times10^5$ Pa.

In another embodiment of the invention, the conditions for uniform distribution of the flows of current-carrying liquid are stabilized, resulting in a substantially uniform hydrodynamic structure of melt over the total ingot length. Stabilization of these conditions are carried out by maintaining the melting current, consumable electrode feed rate, and electrode gap at substantially constant levels. The constant levels of melting current and consumable electrode feed rate are preferably selected to provide for the melting of the consumable electrode in the upper portion of the slag pool with a maximum permissible value of the electrode gap.

In another embodiment of the invention, the melting voltage is smoothly decreased, thus maintaining the level of melting current with maximum permissible electrode gap and feed rate of the consumable electrode substantially constant.

The objects of the invention are also achieved by providing an apparatus for magnetically-controllable, electroslag melting of titanium and titanium-based alloys, comprising:

- a crystallizer provided with an internal volume forming the melting area partially filled with a metered amount of flux;
- a vacuum chamber interfacing with said crystallizer melting area;
- means for supplying said crystallizer with inert gas for developing gauge pressure therewithin;
- means for positioning said consumable electrode inside said melting area in electrical contact with said crystallizer;
- a power supply providing current passage through said consumable electrode and said flux, and subsequent formation of slag and metal pools respectively as the electrode gets melted;
- means for affecting the melting current by way of an external magnetic field having at least two opposite radial constituents disposed in parallel planes, thereby resulting in formation, within the melt volume, of at least two adjoining melt layers rotating horizontally in mutually opposite directions, and in intralayer and substantially meridional toroidal rotations;
- means for carrying out relative travel of an ingot being melted and said crystallizer in the course of crystallization, and for removing a resulting ingot from said crystallizer.

The means for affecting the melting current by way of an external magnetic field preferably comprises at least three ring-shaped conductor members secured to the crystallizer external surface in parallel relationship, and connected so that electric current in adjoining ring members flows in opposite directions. The ring-shaped conductor members are preferably secured to the crystallizer external surface covering the slag and metal pools, and spaced at distances not exceeding half the total depth of the slag and metal pools, with the crystallizer being provided for traveling with respect to an ingot being melted.

In one embodiment, the ring-shaped conductor members are secured to the crystallizer external surface covering the slag and metal pools, and spaced at distances not exceeding half the total depth of said slag and metal pools, with the crystallizer being fixed with respect to an ingot being melted.

In yet another embodiment of the inventive apparatus, a means for stabilizing the melting current is provided, thus resulting in substantially constant levels of the melting current in the mode of maximum permissible electrode gap at a substantially constant feed rate of the consumable electrode.

The apparatuses of the invention are preferably connected to a transformer which can be connected to any known power supply. Furthermore, the means for stabilizing the melting current preferably utilizes a thyristor controller and a control unit connected into a circuit unit of the primary winding of the transformer.

BRIEF DESCRIPTION OF THE DRAWINGS

These and other objects of the invention will become obvious from the following detailed description of specific embodiments with reference to accompanying drawings, in which.

PREFERRED EMBODIMENT OF THE INVENTION

Figure 1:
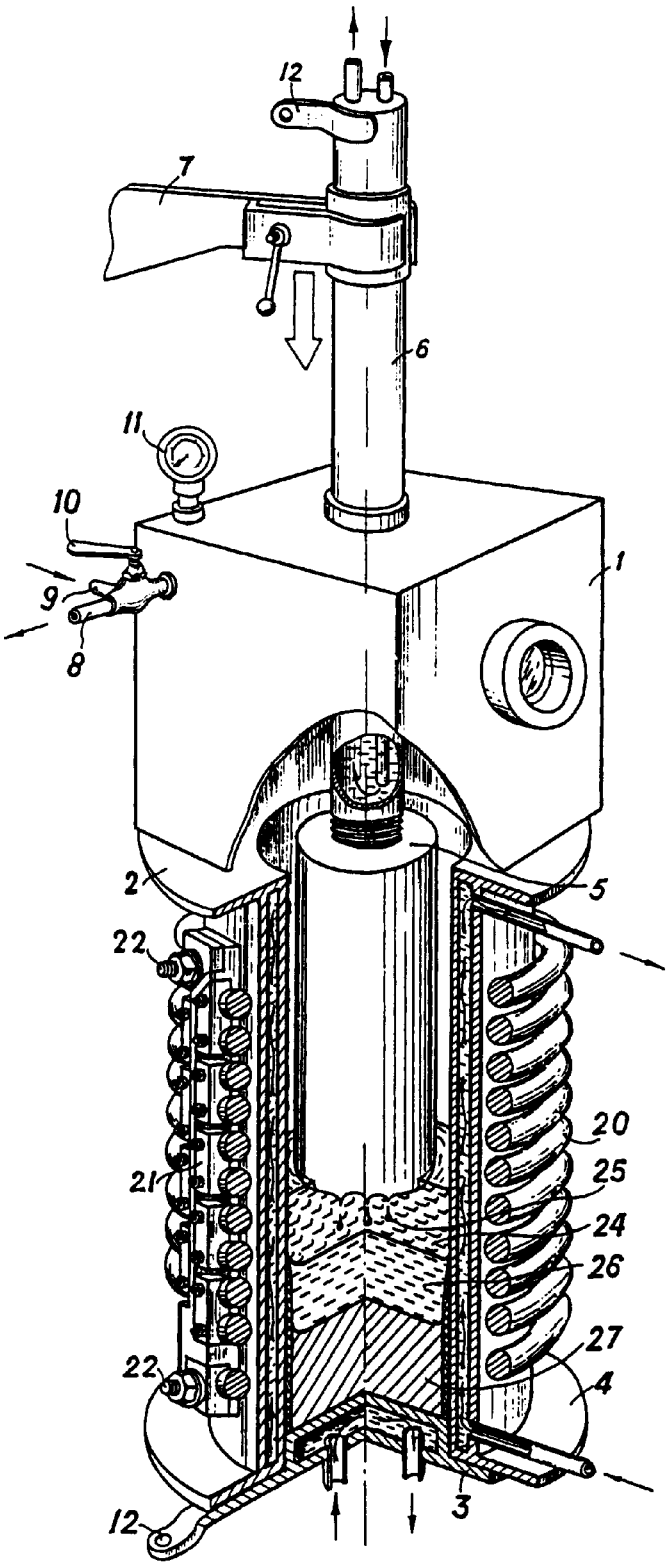
FIG. 1 illustrates a preferred embodiment of the apparatus of the invention, provided with a fixed crystallizer.

The method of the invention is best implemented in the apparatus shown in FIG. 1. This apparatus is provided with a vacuum chamber 1 hermetically connected to a water-cooled crystallizer 2 generally made of copper. A tray 3 of the crystallizer 2 is sealed by a vacuum seal of a flange 4. The apparatus is provided with a consumable electrode 5 made for shifting relative to the crystallizer 2. In embodiments of the invention, electrode 5 may be made of compacted spongy titanium or spongy titanium-containing alloying elements. In the course of repeated melting, the consumable electrode 5 comprises welded together ingots of the first or any subsequent melting. The upper portion of the consumable electrode 5 is connected to a current-carrying rod 6 which is fixed in the device 7 for shifting the electrode 5.

A connecting pipe 8 is used for evacuating air from the chamber 1, e.g., down to a pressure of $10^{-2}$ to $10^{-3}$ atm. Another connecting pipe 9 of the chamber 1 serves for filling this chamber with an inert gas. Control of the passage of air and inert gas is carried out by means of a valve 10. A pressure gauge 11 mounted on the chamber 1 is intended for measuring the pressure of inert gas inside the chamber 1.

Figure 3:
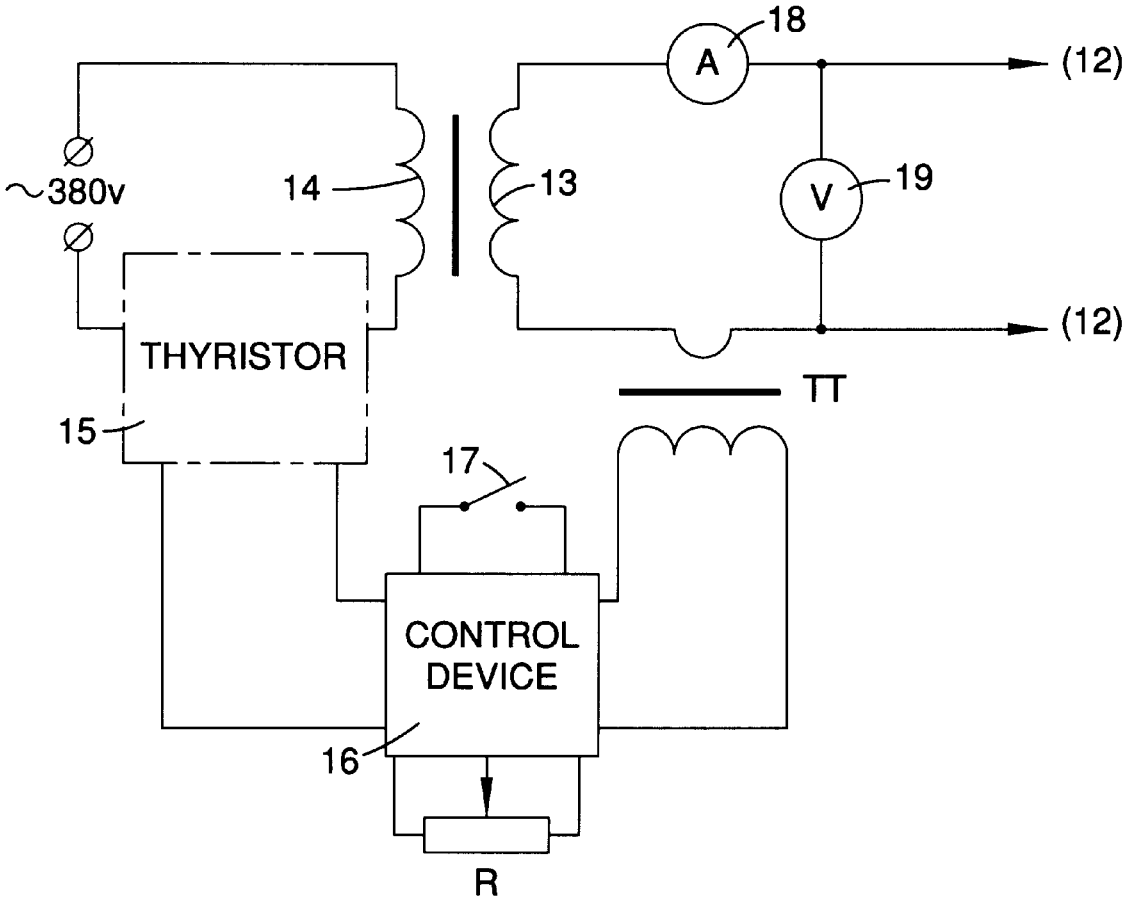
FIG. 3 is a schematic diagram of the power supply provided with the melting current stabilizer.

Electric voltage is supplied to the consumable electrode 5 and crystallizer 2 via current leads 12 of the power supply, e.g., from a power transformer (shown in FIG. 3). A suitable power transformer includes an AC transformer with a current rating of 10, 15, or 20 kA and an open-circuit voltage of 20 to 50 V. Secondary winding circuit 13 of the transformer is connected via current leads 12 to the tray 3 of the crystallizer 2, current-carrying rod 6, and consumable electrode 5.

According to the invention, a thyristor unit 15 is mounted in primary winding circuit 14 of the transformer. This unit, together with a control unit 16, provides smooth control of the melting voltage. In the open position of a switch 17, manual control of voltage is possible in the course of melting of the electrode 5 to maintain the preset level of melting current which is measured by an ammeter 18. Melting voltage is measured by a voltmeter 19.

The automatic stabilization mode may be implemented with the use of any traditional facilities for automatically tracking current deviations from a preset value and sending control signals that ensure a corresponding compensation of melting current decrease and variation of the electrode gap through a smooth decrease of the melting voltage.

According to the invention, the melting current is affected by an external magnetic field having at least two opposite radial constituents disposed in parallel planes. This results in the formation within the melt bulk of at least two adjoining melt layers rotating in opposite directions, along with intra-layer and substantially meridional toroidal rotations of the melt.

In a preferred embodiment of the invention, a source of the external radial magnetic field comprises ring-shaped conductor members 20, a terminal block 21 and current-carrying terminals 22. This source of the external field is mounted on the external surface of the crystallizer 2, along the total length thereof. Here, the distances between adjoining ring-shaped members 20 are preferably less than or equal to half the total depth of slag pool 24 and metal pool 26. The terminal block 21 supplies electric current to the ring-shaped conductor members providing opposite directions of current in the adjoining ring-shaped members.

Figure 2:
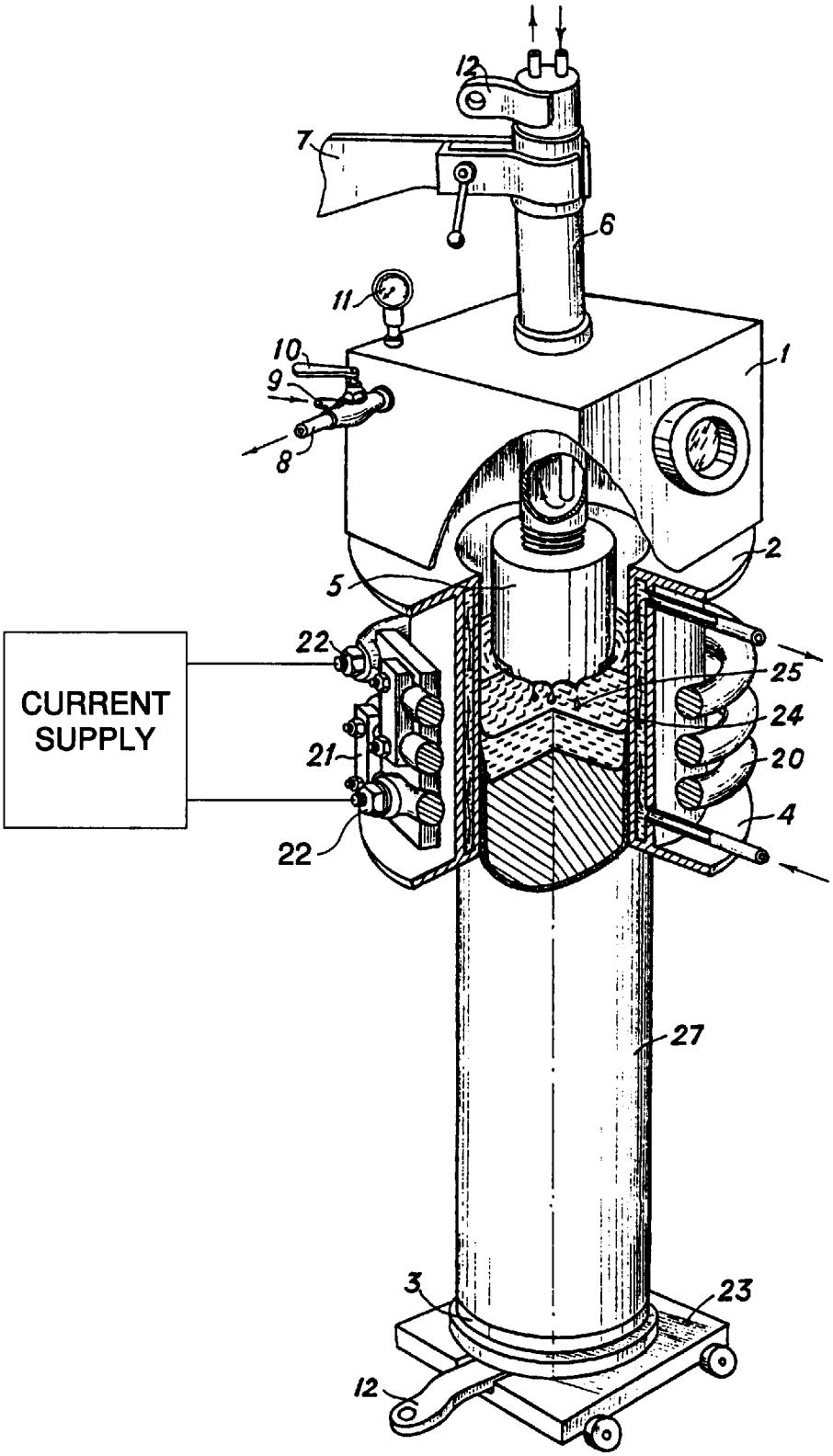
FIG. 2 illustrates another preferred embodiment of the apparatus of the invention, provided with a traveling crystallizer.

In another preferred embodiment, the source of the external field and the ring-shaped conductor members 20 may be secured on the surface of the crystallizer 2 as shown in FIG. 2. To remove the ingot from the crystallizer 2, a trolley 23 may be used.

In the methods of the invention, consumable electrode 5, is passed through crystallizer 2 and vacuum chamber 1 and is brought into short circuit with tray 3 of crystallizer 2, after which tray 3 is covered with flux, generally a powdered fluoride-chloride flux comprising about 85% mass $BaF_2$and 15% mass $CaCl_2$. Tray 3 is sealed with crystallizer 2 by means of the vacuum seal of flange 4. The upper portion of consumable electrode 5 is secured to current-carrying rod 6 fixed in electrode-shifting device 7.

Connecting pipe 8 is utilized to evacuate air from chamber 1, down to a pressure of from about $10^{-2}$ to about $10^{-3}$ atm. Connecting pipe 9 is utilized to fill chamber 1 with an inert gas, which is preferably argon gas. Connecting pipes 8 and 9 are opened and closed by valve 10. According to the invention, the inert gas pressure is from about $0.9\times10^5$ to about $3.6\times10^5$ Pa. Selection, of the lower boundary of the range is determined by the maximum boiling temperatures of the fluxes used, while the upper limit corresponds to the use of the most fusible fluxes having low boiling points. To increase the boiling temperature of the $BaF_2$-$CaCl_2$ system slag above 2200° C., it is preferable to use pressures of from about $1.4\times10^5$ to about $2.0\times10^5$ Pa thus achieving the maximum temperatures of the slag pool. Electric voltage is supplied to the current leads from the power transformer (FIG. 3). The melting voltage is measured by the voltmeter (FIGS. 1, 2). Electric arc is ignited on tray 3, after which electrode 5 begins to descend. The electric arc melts electrode 5 and granulated flux, resulting in formation of slag pool 24. The arc process then changes to an arcless electroslag process. Electrode metal drops 25, passing through the slag pool 24, form the metal bath 26 beneath the slag pool 24. Preset (mode) values are established for melting voltage (e.g., $U_m$=20–22 V) and electrode 5 feed rate (e.g., $V_e$=1–4 m/hr) which ensure a preset melting current that is recorded by ammeter 18. Electrical resistance of the slag pool 24, $R_s$, is much lower than the resistance of the remaining components of the melting circuitry. It governs the amount of heat released in the slag pool 24 for melting of electrode 5 and formation of ingot 27.

$$Q_s=0.24U_sI_m=0.24I_m^2R_s$$

Electrical resistance of consumable electrode 5 when made of titanium, and particularly when made of spongy titanium, is several times higher than that of electrodes made of iron, copper, and aluminum alloys. Correspondingly, the voltage drop in the spongy titanium electrode will be higher. In other words, if the melting voltage, $U_m$, is comprised of the voltage drop, $U_s$, across slag pool 24 and the voltage drop, $U_e$, across consumable electrode 5:

$$U_m=U_s+U_e,$$

the heat released in electrode 5 and slag pool 24 during the passage of melting current, $I_m$, is:

$$Q=0.24U_mI_m=0.24(R_s+R_e)\cdot I_m^2$$

At first, electrode 5 is melted at the surface of metal pool 26 (FIG. 5A) and, in the course of its melting, goes up to the upper layers of slag pool 24. A quasi-stationary electroslag process is established. Electric current is supplied to ring-shaped conductor members 20 via terminals 22 and terminal block 21. Electric current in the adjoining ring-shaped members 20 flows in opposite directions. External magnetic field B interacts with the AC melting current, $I_m$. This interaction results in bulk electromag-netic forces, $F_e$, acting on slag and metal melts along the lines of melting current $I_m$ passing therethrough:

$$\vec{F}_c=\vec{I}_m\times\vec{B}.$$

In the course of melting titanium ingots 27, a large cross-section consumable electrode 5 is used. Its diameter slightly differs from the diameter of slag 24 and metal pool 26. Therefore, melting current, $I_m$, passes in the above pools substantially in the axial direction. To generate electromagnetic forces, $F_e$, that are capable of causing an intense motion of the current-carrying melt, melting current axial constituent, $I_a$, must be affected by the external magnetic field radial constituent, $B_r$:

$$\vec{F}_e=\vec{I}_a\times\vec{B}_r.$$

Figure 4:
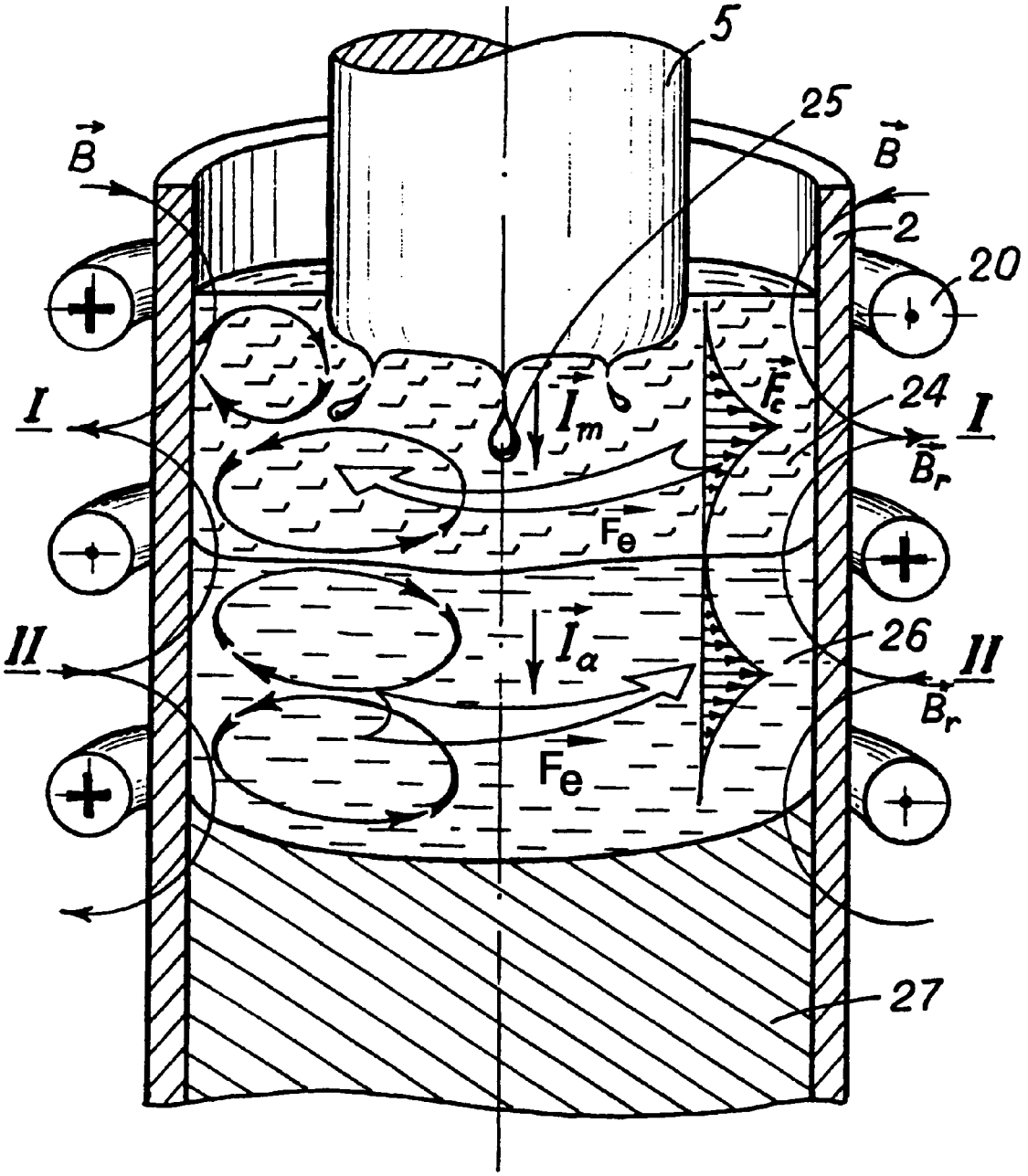
FIG. 4 is a diagram of magnetically-controllable motion in the slag and metal pools in one embodiment of one of the methods of the invention.

When passing electric current through the ring-shaped conductor members 20 (FIGS. 1, 2), counter-directed current in the adjoining ring-shaped members 20 "dampens" the external field axial constituent, $B_a$: it tends to zero. On the other hand, the above passage of current in the ring-shaped members 20 doubles the field radial constituent, $B_r$, between adjoining ring-shaped members 20, as shown in FIG. 4. Here, in adjoining planes I—I and II—II these constituents, $B_r$, are aimed in opposite directions. In the middle, inside each pair of ring-shaped conductor members 20, maximum values of electromagnetic forces, $F_e$, are acting by rotating melt layers between adjoining pairs of the ring-shaped conductor members 20 in opposite directions. In other words, between three ring-shaped conductor members 20 that enclose the crystallizer 2 at the level of slag 24 and metal 26 pools, as shown in FIG. 4, magnetohydrodynamic horizontal rotation of the slag pool 24 occurs in one direction while the metal pool rotates in the opposite direction. This is a primary motion of electromagnetic origin.

As shown in FIG. 4, in the middle of each rotating layer (sections I—I and II—II) centrifugal forces, $F_c$, throwing the melt away to peripheral portions of the pool, will have maximum values. These centrifugal forces, $F_c$, create two toruses rotating in meridional opposite directions inside each horizontally rotating layer. In the melting option shown in FIG. 4, the slag pool 24 horizontally rotates in one direction, and the metal pool 26, in the opposite direction. Here, two toruses are rotating in meridional opposite directions in slag pool 24 and metal pool 26. In case of using four ring-shaped members 20 at the levels of slag 24 and metal pool 26, there will be three horizontally rotating layers, each having two toroidal rotations. Such magnetically-controllable, electroslag melting of titanium and titanium-based alloys is carried out in two versions as shown in FIGS. 1 and 2. In FIG. 1, ingot 27 is melted in fixed crystallizer 2 encircled by the ring-shaped members 20. In FIG. 2, ingot 27 is melted in movable crystallizer 2 provided with the ring-shaped conductor members 20 at the level of slag pool 24 and metal pool 26. Accordingly, crystallizer 2, provided with at least three ring-shaped conductor members 20, is traveling along the ingot 27 at the speed of ingot crystallization.

Figure 5:
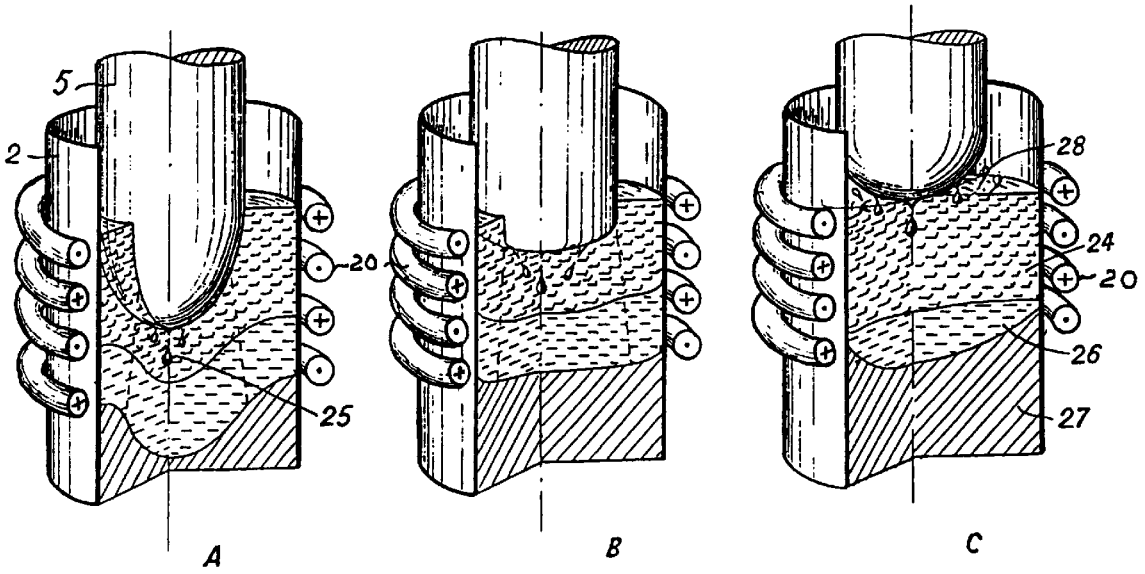
FIG. 5 (A through C) illustrates various possible modes of electrode immersion into the melt.

Heterogeneous quality along the length of ingots produced in compliance with well-known electroslag technologies is mainly associated with the varying rate of their crystallization. The need to maintain a constant value of melting current in the prior art technologies was carried out by varying the feed rate of electrode 5 to the slag pool 24. The crystallization rate of ingot 27 correspondingly changed, thus inhibiting optimum structure and quality of ingot 27. Here, the value of melting voltage in the prior art processes was constant. Such melting started with minimum electrode gaps as shown in FIG. 5A. The end of this process generally involved maximum permissible values of the electrode gaps (FIG. 5B).

According to the invention, magnetically-controllable electroslag melting where the melt is affected by an external magnetic field ensures chemical and physical homogeneity of ingot 27 metal, by maintaining substantially constant levels of both the magnetic field induction, $B_r$, and the melting current, $I_m$, while also maintaining a substantially constant and maximum permissible electrode gap and feed rate of electrode 5. Deep melting of electrode 5 at the surface of metal pool 26 does not permit active control of hydrodynamics of the slag pool 24. Melting of electrode 5 in the middle of slag pool 24 (not shown) provides the possibility of creating magnetohydrodynamic flows only in the lower portion of the slag pool 24. Finally, electrode 5 melting in upper layers of the pool 24, as in the instant invention, allows the intense motion to cover the whole slag pool 24 (FIG. 5B). Without process stabilization, such melting would result in the violation of melting stability due to slopping of slag 28, i.e., a slag-arc process (FIG. 5C).

Stable melting of electrode 5 at the surface of slag pool 24 results in additional activation of molten electrode metal which passes through slag along a complex-shaped path in the form of drops 25. The paths of the drops 25 in the slag pool 24 are governed by both horizontal and toroidal rotations of the slag pool melt. Such an intense and complicated motion results in the formation of a flat bottom of the metal pool 26 and favorable axial growth of crystallites. Here, inclusions are brought out into the melt on the end faces of growing crystallites. Finally, an important consequence of intense and composite-pattern motion in both pools is the uniform distribution of heavy and light alloying elements of multicomponent, high-strength alloys in the metal of ingot 27, and hence an important factor of improving metal quality and performance of products made thereof.

According to the invention, means are provided for stabilizing such processes carried out at maximum permissible electrode gaps and electrode feed rates. In one preferred embodiment, this stabilization is accomplished through smooth decrease in the melting voltage picked up from the secondary winding circuit 13 of the transformer, as shown in FIG. 3. Such adjustment may be carried out by thyristor controller unit 15 and the control unit 16 in the transformer primary winding circuit 14. Values of melting current and voltage are recorded by the ammeter 18 and voltmeter 19, respectively.

According to another aspect of the invention, with stabilization of the optimal hydrodynamic structure of the melt, it also becomes possible to take into account a constant factor affecting slag bath and melting stability. This factor is the development of an optimum inert gas pressure of from about $0.9\times10^5$ to about $3.6\times10^5$ Pa within the chamber 1.

Application of the above range of pressures provides attainment of two goals:

1. Increase in boiling temperatures of fluoride-chloride fluxes up to values exceeding the upper temperature limit of the slag pool.

2. Increase in the pressure exerted on the metal being crystallized, resulting in compaction of intercrystallite boundaries, and hence in an increase in metal plasticity and impact strength.

Melting of electrodes was carried out in 4 modes.

| | |
|---|---|
| Mode 1 (known). | Electroslag melting without external magnetic field. |
| Mode 2 (known). | Magnetically-controllable electroslag welding in a radial magnetic field, with the use of two ring-shaped conductor members. |
| Mode 3. | Magnetically-controllable electroslag welding in a radial magnetic field, with the use of three ring-shaped conductor members. |
| Mode 4. | Magnetically-controllable electroslag welding in a radial magnetic field, with the use of four ring-shaped conductor members. |

Values of melting parameters for ingots of commercial-grade titanium and Ti-5Al-5Mo-5V-1Fe-1Cr alloy, given in Table 1, are the same. Flux of 85% mass $BaF_2$ and 15% mass $CaCl_2$ composition was used; argon pressure was $1.7\times10^5$ Pa.

AC current was used both for melting and ring-shaped conductor members.

Voltage drop across the slag pool during 100 mm diameter electrode melting was $U_s$=21 V; melting current, $I_m$=8300 A; slag pool depth, $h_s$=40 mm; metal pool depth, $h_m$=36 mm; electrode feed rate, $V_e$=2.7–4.3 m/hr. For 160 mm diameter electrodes, these values were as follows: $U_s$=24 V; $I_m$=12600 A; $h_s$=60 mm; $h_m$=57 mm; $V_e$=2.2–3.6 m/hr.

For some technical reasons, at preset parameters of magnetically-controllable melting it is impossible to provide simultaneous effect of a magnetic field generated by more than four ring-shaped conductor members on the melting process.

TABLE 1

| Item No. | Melting mode | Ingot diameter, mm | Qty of ring members, pcs | Space between adjoining ring members, mm | Current magnitude in ring members, A | Radial field induction, T | Ingot formation |
|---|---|---|---|---|---|---|---|
| 1 | 1 | 160 | — | — | — | — | good |
| 2 | 2 | | 2 | 36 | 960 | 0.006 | fair |
| 3 | 3 | | 3 | 36 | | | excellent |
| 4 | 4 | | 4 | 24 | | | excellent |
| 5 | 1 | 250 | — | — | — | — | good |
| 6 | 2 | | 2 | 55 | 1200 | 0.005 | fair |
| 7 | 3 | | 3 | 55 | | | excellent |
| 8 | 4 | | 4 | 38 | | | excellent |

EXAMPLES

The following examples set forth the results of comparative tests of ingots melted in compliance with the inventive method, and those produced by known technologies.

In Examples 1 and 2, 100 mm diameter electrodes made of spongy titanium and spongy titanium with alloying additives were melted to produce 160 mm diameter ingots of commercial grade titanium and Ti-5Al-5Mo-5V-1Fe-1Cr alloy. The above metal ingots were once again melted to produce 250 mm diameter ingots of commercial grade titanium and Ti-5Al-5Mo-5V-1Fe-1Cr alloy.

In the case of melting in Mode 2, radial magnetic field provided, horizontal rotation of the metal melt through the interaction with the melting current in the metal pool. This fact resulted in an unfavorable recess in the axial portion of the metal pool. In the case of Mode 3, opposite radial constituents of the magnetic field caused rotation of slag and metal pools in opposite directions. Secondary toroidal meridional rotations made this motion more complicated. In Mode 4, three horizontal rotating layers were generated in the melt of slag and metal pools. Adjoining layers were rotating in mutually opposite directions. Inside each layer, centrifugal forces generated two rotating meridional toruses, i.e. so-called secondary rotation.

As can be seen from Table 1, magnetically-controllable, electroslag melting with the use of a radial electromagnetic field generated by three and four ring-shaped conductors in Modes 3 and 4, provided excellent, high-quality formation of ingots.

In the course of the melting process 20, modes 1 through 4 were characterized by variation, of the electrode gaps and melting current passage paths in slag and metal pools; as a result, the hydrodynamic structure of melts in the above meltings also varied. Thus, in Mode 1 a meridional toroidal rotation of a melt occurs, generating a crater beneath the electrode in a metal pool, thereby degrading metal quality. In Mode 2, the melt was in rotational motion, resulting in an increase of the recess of the axial portion of the metal pool and negatively affecting metal quality. In Mode 3, the slag melt rotated in one direction, and metal melt in the opposite direction. In combination with a secondary intralayer motion, this arrangement permitted metal purification from admixtures, gas pores and inclusions, thereby improving metal plasticity and impact toughness. Similar results were obtained in generating a three-layer melt rotation in Mode 4.

Examples 1 and 2 also set forth the results of studies of the composition and mechanical properties of metal in ingots of commercial-grade titanium and Ti-5Al-5Mo-5V-1Fe-1Cr alloy, produced in Modes 1 through 4.

The preset melting current whose values are given in Table 1 was maintained by continuous variation of the electrode feed rate.

Example 1

The above Modes were used for melting 8 ingots of commercial-grade titanium, including 4 ingots of first melting, 160 mm in diameter, and 4 ingots of second melting, 250 mm in diameter.

The features of hydrodynamic structure of metallurgical melt in case of melting in Modes 1 and 2 governed unfavorable radial growth of crystallites. As a result, gas pores and slag inclusions were found, metal purification was insufficient and metal plasticity and impact toughness were low. As indicated in Table 2, intense and complicated motion of the melt in Modes 3 and 4 activated the process of metal purification of gas admixtures. The flat bottom of the metal pool caused favorable growth of ingot crystallites: the axial area of metal was free of gas pores and slag inclusions. Metal plasticity and impact strength were much higher than in metal produced in Modes 1 and 2. The quality of metal produced as a result of first and second meltings was identical.

TABLE 2

| Item | Melting | Ingot Diameter, | Composition, mass % | | | Mechanical Properties | | | Gas | |
|---|---|---|---|---|---|---|---|---|---|---|
| | | | | | | elongation | reduction of | Impact toughness, | Pore | Slag |
| No. | Mode | nm | oxygen | nitrogen | hydrogen | % | area, % | J/cm$^2$ | s | Inclusions |
| 1 | 1 | | 0.13 | 0.050 | 0.006 | 18.9 | 47.2 | 194 | yes | no |
| 2 | 2 | 160 | 0.13 | 0.060 | 0.006 | 15.2 | 31.0 | 145 | yes | yes |
| 3 | 3 | | 0.12 | 0.045 | 0.004 | 26.1 | 55.9 | 238 | no | no |
| 4 | 4 | | 0.11 | 0.040 | 0.005 | 25.8 | 56.0 | 236 | no | no |
| 5 | 1 | 250 | 0.12 | 0.045 | 0.006 | 18.4 | 48.0 | 188 | yes | no |
| 6 | 2 | | 0.12 | 0.060 | 0.005 | 14.9 | 30.5 | 149 | yes | yes |
| 7 | 3 | | 0.11 | 0.050 | 0.005 | 28.6 | 59.1 | 241 | no | no |
| 8 | 4 | | 0.11 | 0.045 | 0.004 | 27.1 | 57.8 | 240 | no | no |

Example 2

The above Modes were used for melting 8 ingots of Ti-5Al-5Mo-5V-1Fe-1Cr multi-component, high-strength alloy, including 4 ingots of first melting, 160 mm in diameter, and 4 ingots of second melting, 250 mm in diameter.

TABLE 3

| Item | Melting | Ingot diameter, | Composition, mass % | | | | | Mechanical properties | |
|---|---|---|---|---|---|---|---|---|---|
| | | | | | | | | elongation, | impact toughness |
| No. | mode | mm | Al | Mo | V | Fe | Cr | % | J/cm$^2$ |
| 1 | 1 | 160 | 4.8 | 5.3 | 5.2 | 1.2 | 1.1 | 5 | 31 |
| 2 | 2 | | 4.9 | 5.4 | 5.1 | 1.3 | 1.2 | 5 | 28 |
| 3 | 3 | | 5.0 | 5.1 | 5.0 | 1.0 | 0.9 | 8 | 42 |
| 4 | 4 | | 4.9 | 5.0 | 5.1 | 0.9 | 1.1 | 7 | 39 |
| 5 | 1 | 250 | 4.9 | 5.1 | 5.2 | 1.1 | 1.2 | 6 | 30 |
| 6 | 2 | | 4.8 | 5.2 | 5.3 | 1.2 | 1.1 | 5 | 29 |
| 7 | 3 | | 5.0 | 5.0 | 5.1 | 1.0 | 1.0 | 8 | 43 |
| 8 | 4 | | 5.1 | 5.1 | 5.0 | 1.0 | 1.1 | 8 | 38 |

As shown in Table 3, metal produced in Modes 1 and 2 are characterized by nonuniform distribution of alloying elements which, when combined with insufficient purification of metal from admixtures, gas pores and inclusions, resulted in low values of plasticity and impact toughness.

Intense and complicated motion of melt in Modes 3 and 4 provided substantial purification of metal from admixtures, removal of gas pores and inclusions and, importantly, chemical and physical homogeneity of ingot metal. As a result, metal plasticity and impact toughness were considerably higher than in case of melting in known modes.

TABLE 4

| Item No. | Argon pressure, $10^5$ Pa | Elongation, % | Reduction of area, % | Impact toughness, J/cm$^2$ | Ingot formation |
|---|---|---|---|---|---|
| 1 | 1.1 | 17.4 | 42.1 | 203 | fair |
| 2 | 1.7 | 31.9 | 76.1 | 292 | excellent |
| 3 | 3.6 | 28.3 | 73.2 | 276 | good |

Example 3

This example illustrates the carrying out of the melting process under elevated pressures of inert gas in compliance with one aspect of the method of the invention.

Three ingots of commercial-grade titanium were produced, 160 mm in diameter, using Mode 3 of melting, under the effect of separate magnetic fields and pressures demonstrated in Table 4. Flux of 85% mass $BaF_2$ and 15% mass $CaCl_2$ was used.

Under a pressure of $1.1\times10^5$ Pa, deterioration of the process stability was noted due to the evaporation of volatile components of the slag pool. As can be seen from the data of Table 4, this fact resulted in a noticeable decrease of metal plasticity and impact toughness, combined with fair formation of an ingot. An increase in the argon pressure within the melting area above $3.6\times10^5$ Pa was restricted by technical factors. Optimum values of plasticity, impact toughness and ingot formation were achieved at a pressure of $1.7\times10^5$ Pa. Under this pressure, no boiling or sublimation (volatilization) of the slag pool components took place.

Examples 4 through 6 below are intended to provide specific melting conditions with account of the depth of electrode immersion under conditions of stabilization proposed in compliance with another aspect of this invention.

First and second melting ingots were produced, and their quality was studied. One hundred (100) mm diameter electrodes made of spongy titanium and spongy titanium with alloying elements were melted to produce 160 mm diameter ingots of commercial-grade titanium and Ti-5Al-5Mo-5V-1Fe-1Cr alloy.

TABLE 5

| Item No. | Melting mode | Ingot diameter mm | Qty of ring members, pcs | Melting current, A | Current in ring members, A | Electrode immersion depth, mm | Electrode feed rate, m/hr |
|---|---|---|---|---|---|---|---|
| 1 | 1 | 160 | 3 | 8300 | 960 | 36 | 3.3 |
| 2 | 2 | | 4 | | | | |
| 3 | 3 | | 3 | | | 20 | 2.7 |
| 4 | 4 | | 4 | | | | |
| 5 | 5 | | 3 | | | 5 | 2.1 |
| 6 | 6 | | 4 | | | | |
| 7 | 1 | 250 | 3 | 12600 | 1200 | 55 | 2.7 |
| 8 | 2 | | 4 | | | | |
| 9 | 3 | | 3 | | | 30 | 2.2 |
| 10 | 4 | | 4 | | | | |
| 11 | 5 | | 3 | | | 6 | 1.7 |
| 12 | 6 | | 4 | | | | |

The above ingots were once again melted to produce 250 mm diameter ingots of commercial-grade titanium and Ti-5Al-5Mo-5V-1Fe-1Cr alloy. Flux composition was 85% mass $BaF_2$ and 15% mass $CaCl_2$. Argon pressure within the melting area was $1.7\times10^5$ Pa.

As shown in Table 5, electrodes were melted in 6 modes.

| | |
|---|---|
| Modes 1,2 | Magnetically-controllable, electroslag melting with deep electrode melting. In Mode 1, a radial magnetic field was generated by three ring-shaped conductors. In Mode 2, a radial magnetic field was generated by four ring-shaped conductors. |
| Modes 3,4 | Magnetically-controllable, electroslag melting with electrode melting in the middle of a slag bath. In Mode 3, a radial magnetic field was generated by three ring-shaped conductors. In Mode 4, a radial magnetic field was generated by four ring-shaped conductors. |
| Modes 5,6 | Magnetically-controllable, electroslag melting with electrode melting at the surface of a slag bath. In Mode 5, a radial magnetic field was generated by three ring-shaped conductors. In Mode 6, a radial magnetic field was generated by four ring-shaped conductors. |

Voltage drop across the slag pool in melting of 100 mm diameter electrode was $U_s$=21 V; slag pool depth, $h_s$=40 mm; metal pool depth, $h_m$=36 mm; in case of 160 mm diameter electrode, mode parameters were: $U_s$=24 V; $h_s$=60 mm; $h_m$=57 mm.

The motion of slag melt is generated by electromagnetic forces caused by interaction between melting current and radial external field. As a result, the melting process in Modes 1 and 2 with a minimum electrode gap is characterized by a magnetohydrodynamic stirring that involves only lower layers of the pool. This results in unfavorable conditions for metal purification and distribution of alloying elements. The melting process in Modes 3 and 4 is characterized by an increase in the volume of slag melt, covered by magnetohydrodynamic stirring. About one half of the slag pool, (its lowermost portion) is in a state of intense motion. Finally, the melting process in Modes 5 and 6 is characterized by an intense motion of the whole slag pool because the electromagnetic forces are generated next to melting current lines, from the slag pool surface, and to the metal pool surface. Such motion provides better conditions for metal purification and distribution of alloying elements therewithin.

Example 4

Modes 1 through 6 were used to produce 6 ingots of commercial-grade titanium 160 mm in diameter, and 6 ingots 250 mm in diameter. Table 6 sets forth data which indicates that the electrode deep melting mode resulted in ingots having gas pores; their metal is insufficiently purified and has low plasticity and impact toughness. As the electrode end face goes up in the course of melting to upper layers of the slag pool, the level of metal purification from admixtures increases, thereby resulting in improvement of its plasticity and impact toughness. Gas pores and inclusions are totally absent. The lowest contents of admixtures and higher mechanical properties were registered in case of electrode melting at the slag pool surface.

TABLE 6

| Item | Melting | Ingot diameter, mm | Composition, mass % | | | Mechanical properties | | Gas | Slag |
|---|---|---|---|---|---|---|---|---|---|
| | | | | | | elongation | Impact toughness | | |
| No. | mode | | oxygen | nitrogen | hydrogen | % | J/cm$^2$ | pores | inclusions |
| 1 | 1 | 160 | 0.15 | 0.056 | 0.006 | 25.7 | 209 | yes | no |
| 2 | 2 | | 0.14 | 0.054 | 0.007 | 27.3 | 215 | yes | no |
| 3 | 3 | | 0.13 | 0.047 | 0.005 | 31.1 | 261 | no | no |
| 4 | 4 | | 0.13 | 0.050 | 0.005 | 30.8 | 258 | no | no |
| 5 | 5 | | 0.11 | 0.040 | 0.004 | 35.2 | 295 | no | no |
| 6 | 6 | | 0.12 | 0.044 | 0.003 | 33.9 | 291 | no | no |
| 7 | 1 | 250 | 0.14 | 0.054 | 0.005 | 26.3 | 214 | yes | no |
| 8 | 2 | | 0.13 | 0.060 | 0.006 | 27.9 | 210 | yes | no |
| 9 | 3 | | 0.12 | 0.043 | 0.005 | 30.3 | 265 | no | no |
| 10 | 4 | | 0.13 | 0.045 | 0.004 | 30.7 | 262 | no | no |
| 11 | 5 | | 0.11 | 0.038 | 0.003 | 34.9 | 305 | no | no |
| 12 | 6 | | 0.10 | 0.042 | 0.003 | 35.2 | 296 | no | no |

Example 5

Modes 1 through 6 were used to produce 12 ingots of Ti-5Al-5Mo-5V-1Fe-1Cr alloy. From this number 6 ingots were 160 mm in diameter; another 6 ingots 250 mm in diameter were produced by repeated melting. As can be seen from the data given in Table 7, the best results of uniform distribution of alloying elements and highest mechanical properties were provided in melting modes 5 and 6, where electrode melting took place in upper layers of the slag pool, while providing a minimum permissible electrode gap.

Example 6

In all the well-known melting methods involving electroslag processes, the electrode gap size at the beginning of the process is minimum, and at the end of the process is maximum. As a result, the quality of ingot is heterogeneous over the length thereof (melting mode 1, Table 8). Melting Mode 2 given in this Table is characterized by electrode melting at the slag pool surface, at maximum permissible electrode gap which according to the invention is maintained constant together with the melting current by smoothly decreasing the melting voltage as the electrode gets melted.

TABLE 7

| Item | Melting | Ingot diameter, | Composition, mass % | | | | | Mechanical Properties | |
|---|---|---|---|---|---|---|---|---|---|
| | | | | | | | | Elongation, | Impact toughness, |
| No. | Mode | mm | Al | Mo | V | Fe | Cr | % | J/cm$^2$ |
| 1 | 1 | 160 | 5.4 | 5.2 | 5.3 | 0.8 | 1.2 | 9 | 48 |
| 2 | 2 | | 5.3 | 5.3 | 4.9 | 1.1 | 1.0 | 8 | 44 |
| 3 | 3 | | 5.2 | 6.0 | 5.0 | 1.0 | 1.1 | 11 | 55 |
| 4 | 4 | | 5.1 | 4.9 | 5.2 | 0.9 | 1.0 | 10 | 57 |
| 5 | 5 | | 5.0 | 5.0 | 4.9 | 1.0 | 0.9 | 15 | 65 |
| 6 | 6 | | 5.1 | 5.0 | 5.0 | 1.0 | 1.0 | 17 | 61 |
| 7 | 1 | 250 | 5.3 | 5.1 | 5.4 | 0.7 | 1.3 | 8 | 51 |
| 8 | 2 | | 5.4 | 5.2 | 5.0 | 0.9 | 0.9 | 9 | 49 |
| 9 | 3 | | 5.2 | 4.9 | 5.2 | 1.1 | 1.2 | 12 | 56 |
| 13 | 4 | | 5.2 | 5.1 | 5.0 | 1.0 | 1.0 | 10 | 52 |
| 11 | 5 | | 5.1 | 4.9 | 4.9 | 1.0 | 1.0 | 14 | 63 |
| 12 | 6 | | 5.0 | 5.0 | 5.0 | 1.0 | 0.9 | 16 | 64 |

TABLE 8

| Item | Melting | Ingot diameter | Melting voltage, V | | | Melting current | Current in ring conductors, |
|---|---|---|---|---|---|---|---|
| No. | mode | mm | bottom | middle | top | A | A |
| 1 | 1 | 160 | | 32 | | 8600 | 960 |
| 2 | 2 | | 37 | 32 | 27 | | |
| 3 | 1 | 250 | | 30 | | 12900 | 1200 |
| 4 | 2 | | 33 | 30 | 27 | | |

Modes 1 and 2 were used to produce 4 ingots of Ti-5Al-5Mo-5V-1Fe-1Cr alloy. From this number, 2 ingots were 160 mm in diameter. Another 2 ingots that were 250 mm in diameter were produced by repeated melting.

Results of analyzations of the composition and mechanical properties of the metal in these ingots are given in Table 9. This data demonstrates that, in the case of melting current stabilization by means of electrode feed rate in compliance with a prior art method, the quality of ingots is not uniform over their length (Mode 1). In the case of melting current stabilization while maintaining constant electrode feed rate according to the method of the invention (Mode 2), the quality of metal in ingots is homogeneous. In other words, during the whole melting process in Mode 2, the maximum permissible electrode gap is maintained. Here, the whole slag pool is involved in intense magnetohydrodynamic motion. This results in the provision of a high level of chemical and physical homogeneity of ingot metal over the ingot length, total absence of gas pores and inclusions, and high values of metal plasticity and impact toughness.

TABLE 9

| Item No. | Melting mode | Ingot diameter, mm | Sampling location | Composition, mass % Al | Mo | V | Fe | Cr | Mechanical properties Elongation, % | Impact toughness, J/cm$^2$ |
|---|---|---|---|---|---|---|---|---|---|---|
| 1 | 1 | 160 | bottom | 5.3 | 4.8 | 5.1 | 0.5 | 1.1 | 9 | 45 |
| | | | middle | 5.2 | 4.9 | 5.0 | 0.9 | 1.0 | 11 | 52 |
| | | | top | 5.0 | 4.9 | 5.1 | 1.0 | 1.0 | 15 | 64 |
| 2 | 2 | | bottom | 4.9 | 5.1 | 5.0 | 1.1 | 1.0 | 15 | 63 |
| | | | middle | 5.0 | 5.1 | 5.0 | 1.0 | 1.0 | 14 | 58 |
| | | | top | 5.0 | 5.0 | 4.9 | 0.9 | 1.0 | 16 | 65 |
| 2 | 2 | 250 | bottom | 4.7 | 5.2 | 5.0 | 1.2 | 1.1 | 10 | 47 |
| | | | middle | 4.8 | 5.1 | 5.1 | 1.0 | 0.9 | 12 | 50 |
| | | | top | 5.0 | 5.0 | 4.9 | 0.9 | 1.0 | 14 | 59 |
| 4 | 2 | | bottom | 5.0 | 5.0 | 4.9 | 0.9 | 1.1 | 14 | 63 |
| | | | middle | 5.0 | 5.1 | 4.9 | 1.0 | 1.1 | 12 | 59 |
| | | | top | 4.9 | 5.0 | 5.1 | 1.0 | 1.0 | 13 | 61 |

Due to the application of the method of the invention and apparatus for carrying out the same, it is possible to produce a metal that is chemically and physically homogeneous, free from any gas admixtures and bubbles, and inclusions. Crystallite boundaries are compacted. An important feature is that, after the first melting, distribution of alloying elements in the metal is characterized by a high degree of homogeneity which is provided through complicated and intense horizontal and vertical magnetohydrodynamic stirring. The metal produced in the course of the first melting is slightly different from the metal produced by repeated meltings and meets all specifications. It is characterized by high values of plasticity and impact toughness and, importantly, by high cyclic durability required to provide a sufficient service life for important assemblies made of such metal.

Economic advantages of the methods of the invention include utilization of less expensive equipment as compared to the traditional technologies, the possibility of using cheaper alternating current, and the absence of any burning-out or local precipitation in the course of melting alloying components. Metal refinement obtained in the course of melting in accordance with the methods of the invention permits utilization of a lower-grade spongy titanium for electrode production. Combined with a smaller number of melting stages, this results in a significant decrease in the production cost when using the inventive methods.

The priority area of utilization of the methods of the invention comprises production of high-strength, multicomponent alloys for aerospace industry products. The methods of the invention result in longer service life for such products.

It is noted that the sequence of operations of the embodiment of the invention, described above and shown in the Figures, represents only a possible preferred embodiment of the invention. Those skilled in the art will appreciate that various modifications can be made which still fall within the scope of the invention as claimed. Thus, according to the inventive method, other refractory metals and alloys may be melted, particularly zirconium and zirconium-based alloys, and stainless Cr-Ni steels.

We claim:

1. A method of melting comprising:

(a) in a crystallizer including structure defining an enclosed vacuum chamber having an electrode end and an opposed crystallizer end and having a shiftable electrode holder configured to couple electrically with and hold a consumable electrode in said chamber, attaching a consumable electrode to said holder spaced from said crystallizer end adding flux to said chamber, said consumable electrode composed of material selected from the group consisting of spongy titanium, spongy titanium with alloying additives, titanium and titanium-based alloys;

(b) imposing a voltage between said electrode and said crystallizer end in order to produce a current for melting said electrode and flux in order to form metal and slag pools;

(c) feeding said electrode toward said crystallizer end at a selected, substantially constant feed rate, step (b) including the step of decreasing said voltage as needed in order to maintain said current at a selected, substantially constant current flow in coordination with said constant feed rate in order to stabilize the formation of the total length of said ingot; and (d) cooling said crystallizer end in order to form a metal ingot adjacent thereto from said metal pool.

2. The method of claim 1 including the step of supplying an inert gas to said vacuum chamber.

3. The method of claim 2 including the step of supplying argon as said inert gas.

4. The method of claim 2 including the step of supplying said inert gas at a pressure of between about $0.9\times10^5$ and $3.6\times10^5$ Pa.

5. The method of claim 4 including the step of supplying said inert gas at a pressure of between about $1.4\times10^5$ and $2.0\times10^5$ Pa.

6. The method of claim 1 including the step of selecting said constant feed rate and said constant current flow to provide melting of said electrode in the upper portion of said slag pool at a maximum permissible electrode gap.

7. The method of claim 1, including the step of stabilizing the conditions in said chamber for a uniform hydrodynamic structure of the melt area over the total length of said ingot.

8. The method of claim 1, including the step of stabilizing the conditions in said chamber by maintaining constant values of melting current, electrode feed and electrode gap.

9. The method of claim 1 including the step of maintaining said constant current flow and said constant feed rate of said electrode at maximum permissible electrode gap by smoothly decreasing said voltage.

10. A method of melting comprising:

(a) in a crystallizer including structure defining an enclosed vacuum chamber having an electrode end and an opposed crystallizer end and having a shiftable electrode holder configured to couple electrically with and hold a consumable electrode in said chamber, attaching a consumable electrode to said holder spaced from said crystallizer end, adding flux to said chamber, and supplying an inert gas to said vacuum chamber, said consumable electrode composed of a material selected from the group consisting of spongy titanium, spongy titanium with alloying additives, titanium and titanium-based alloys;

(b) imposing a voltage between said electrode and said crystallizer end in order to produce a current for melting said electrode and flux in order to form metal and slag pools;

(c) feeding said electrode toward said crystallizer end at a selected, substantially constant feed rate, step (b) including the step of decreasing said voltage as needed in order to maintain said current at a selected, substantially constant current flow in coordination with said constant feed rate in order to stabilize the formation of the total length of said ingot; and (d) cooling said crystallizer end in order to form a metal ingot adjacent thereto from said metal pool.

11. The method of claim 10 including the step of supplying argon as said inert gas.

12. The method of claim 10 including the step of supplying said inert gas at a pressure of between about $0.9\times10^5$ and $3.6\times10^5$ Pa.

13. The method of claim 12 including the step of supplying said inert gas at a pressure of between about $1.4\times10^5$ and $2.0\times10^5$ Pa.

14. The method of claim 10 including the step of selecting said constant feed rate and said constant current flow to provide melting of said electrode in the upper portion of said slag pool at a maximum permissible electrode gap.

15. The method of claim 10, including the step of stabilizing the conditions in said chamber for a uniform hydrodynamic structure of the melt area over the total length of said ingot.

16. The method of claim 10, including the step of stabilizing the conditions in said chamber by maintaining constant values of melting current, electrode feed and electrode gap.

17. The method of claim 10 including the step of maintaining said constant current flow and said constant feed rate of said electrode at maximum permissible electrode gap by smoothly decreasing said voltage.

* * * * *